455/3

United States Patent [19]

Watanabe

[11] 4,139,843

[45] Feb. 13, 1979

[54] ALARM SYSTEM

[75] Inventor: Masakatsu Watanabe, Tokyo, Japan

[73] Assignee: Hochiki Corporation, Tokyo, Japan

[21] Appl. No.: 911,414

[22] Filed: May 30, 1978

[30] Foreign Application Priority Data

May 31, 1977 [JP] Japan ..... 52-63668

[51] Int. Cl.[2] ..... G08B 1/08

[52] U.S. Cl. ..... 340/505; 340/531; 340/152 T

[58] Field of Search ..... 340/152 T, 288, 505, 340/531; 358/86; 325/55, 308

[56] References Cited

U.S. PATENT DOCUMENTS

| | | | |
|---|---|---|---|
| 3,996,578 | 12/1976 | Takeuchi et al. | 340/531 |
| 4,114,150 | 9/1978 | Yamazaki et al. | 340/531 |

*Primary Examiner*—Alvin H. Waring
*Attorney, Agent, or Firm*—Haseltine, Lake & Waters

[57] ABSTRACT

In an alarm system utilizing a bidirectional wired television system, a large number of subscribers are combined in a plurality of group units, whereby the subscribers in each group unit are assigned with specified frequencies which are common to the respective group units but are different for the respective subscribers in the group unit, and the respective group units are assigned with another specified frequencies which are different for the respective group units. The group units are sequentially polled by interrogating signals comprising said another specified frequencies and applied from a central station, whereby when any subscriber in the polled group has an abnormal condition at its location, the subscriber answers to the polling by a signal of the specified frequency assigned to it. The central station discriminates and displays the answering subscriber in accordance with the combination of the frequency of the received answer signal and the specified frequency being generated for polling at the time that the answer signal was received.

4 Claims, 4 Drawing Figures

ALARM SYSTEM

BACKGROUND OF THE INVENTION

The present invention relates to an alarm system utilizing a bidirectional wired television system, such as, a bidirectional community antenna television system or CATV system.

Systems for providing an alarm service to a large number of subscribers from a remotely located central station are known in the art, as for example, polling systems of the type disclosed in U.S. Pat. No. 3,765,016 in which a plurality of subscribers are sequentially interrogated to answer as to the occurrence of an abnormal condition and contention systems of the type disclosed in U.S. Pat. No. 3,996,578 in which the subscribers each detecting the occurrence of an abnormal condition in its monitoring area sends an alarm signal to the central station, and many systems of these types have been put in practical use. However, a system which is capable of handling a relatively large number of subscribers inexpensively is very scarce. With the coaxial cable network of the CATV system, the coaxial cables are generally installed to branch off the community antenna to the respective subscribers. In the system disclosed in U.S. Pat. No. 3,765,016, the central station is connected to a transmission loop having a plurality of series connected subscribers and a normally closed line relay is connected in series with each subscriber in the loop, thus making it impossible to utilize the previously mentioned CATV network of the branched-off coaxial cables as such. Another disadvantage is that since the interrogating signals for polling are pulse code signals and since each subscriber is connected in series with the transmission line, the cycle time required for the polling is long so that if the number of subscribers is increased, the time interval from the time that each subscriber receives the interrogating signal until the subscriber receives the next interrogating signal is increased, thus making it impossible to make an early alarming.

On the other hand, in the contention system of the type disclosed in U.S. Pat. No. 3,996,578, different frequencies are assigned to the respective subscribers and another different frequencies are assigned to the respective groups each including a plurality of the subscribers so as to discriminate the subscriber which has sent an alarm in accordance with the values of the frequencies associated therewith, thus requiring a large number of frequency discriminating devices, such as, demodulators, tuners or band-pass filters. Another disadvantage is that particularly where an alarm signal includes a signal indicative of the type of abnormal condition, such as, fire, burglary or gas leakage and the type of abnormal condition must be discriminated at the central station, the assignment of frequencies tends to become more difficult as the number of subscribers is increased, thus setting a limit to the maximum number of subscribers which would permit effective discrimination of the terminals and types of abnormal condition with a limited frequency band. While this disadvantage involved in the discrimination of the types of abnormal condition can be overcome by polling the subscribers for every type of abnormal condition, the interrogating signals for polling must also contain signal components indicative of the types of abnormal condition, and the types of abnormal condition are generally discriminated in accordance with different frequency component, thus further increasing the frequency band required for the polling interrogating signals. As a result, the discrimination of a large number of subscribers and a plurality of types of abnormal condition in accordance with different frequency signals within the limited transmission band of the CATV cable network, sets by itself a limit.

SUMMARY OF THE INVENTION

It is an object of the present invention to provide an alarm system which requires a comparatively small number of types of frequencies used and hence capable of serving a large number of terminals, can be constructed inexpensively and ensures a reduction in the required time for alarm.

It is another object of the invention to provide an alarm system in which a large number of subscribers are combined in a plurality of group units so as to simultaneously interrogate all the subscribers in every group unit, whereby when a plurality of the subscribers in the same group unit have answered, their answer signals are simultaneously sent to the central station and the subscribers are discriminated from one another in accordance with the specified frequencies assigned to the subscribers, thus reducing the polling cycle time.

It is still another object of the invention to provide an inexpensive alarm system which is well suited for use with a CATV system for the subscribers crowded in a small area such as a building, wherein each subscriber is adapted to answer by the one and only alarm signal to the polling and the type of the abnormal condition which has occurred at the location of the answering subscriber is confirmed by the person in charge who visits the location or by interrogating the answering subscriber through an interphone, thus giving the highest priority to early alarm of the occurrence of an abnormal condition.

In accordance with the invention, there is thus provided an alarm system wherein a central station is connected to the output side of a head end of a coaxial cable network of a bidirectional wired television system, whereby the interrogating signals for polling are delivered as down-signals from the central station to a large number of subscribers through the coaxial cable network and the answer signals from the subscribers are received as up-signals by the central station through the coaxial cable network. The subscribers are combined in a plurality of group units, and assigned to the subscribers in each group unit are specified frequencies which are common to the respective group units but are different for the subscribers in each group unit. Another different specified frequencies are assigned to the respective group units, and consequently any subscriber in any group unit can be specified in accordance with the combination of the corresponding assigned frequencies. The central station transmits interrogating signals comprising the signal components of the specified frequencies assigned to the group units, and all the subscribers in each group unit are simultaneously polled by the applied interrogating signal. In other words, after all the subscribers in one group unit have been simultaneously polled, all the subscribers in the next group unit are similarly polled simultaneously. In this way, all of the subscribers can be simultaneously polled for every group unit to which they belong, and the group units may be the respective floors of a building or the various sections of a sectionalized building floor.

When any subscriber detects the occurrence of an abnormal condition, such as, a fire, gas leakage or burglary, the subscriber transmits to the central station an alarm signal of the specified frequency assigned thereto in response to the receipt of the interrogating signal of the specified frequency corresponding to the group unit to which the subscriber belongs. When the answer by this alarm signal is received, the central station discriminates the specified frequency of the alarm signal and then the location of the subscriber which has transmitted the alarm signal is discriminated and displayed in accordance with the conbination of the discriminated specified frequency and the frequency component of the interrogating signal causing the answer signal. In accordance with the present invention, the subscribers are polled for every group unit instead of polling the subscribers one by one. As a result, the total number of times of polling is equal to the number of the group units which is usually much smaller than the total number of the subscribers, thus reducing the required polling cycle time and providing to be effective in ensuring early alarming. When a plurality of the subscribers in the same group unit simultaneously answer to the polling, the subscribers can be discriminated in accordance with the specified frequencies assigned to them.

The above and other objects, features and advantages of the present invention will become apparent from the following description of the preferred embodiment, the accompanying drawings and the attached claims.

DESCRIPTION OF THE PREFERRED EMBODIMENT

Figure 1:
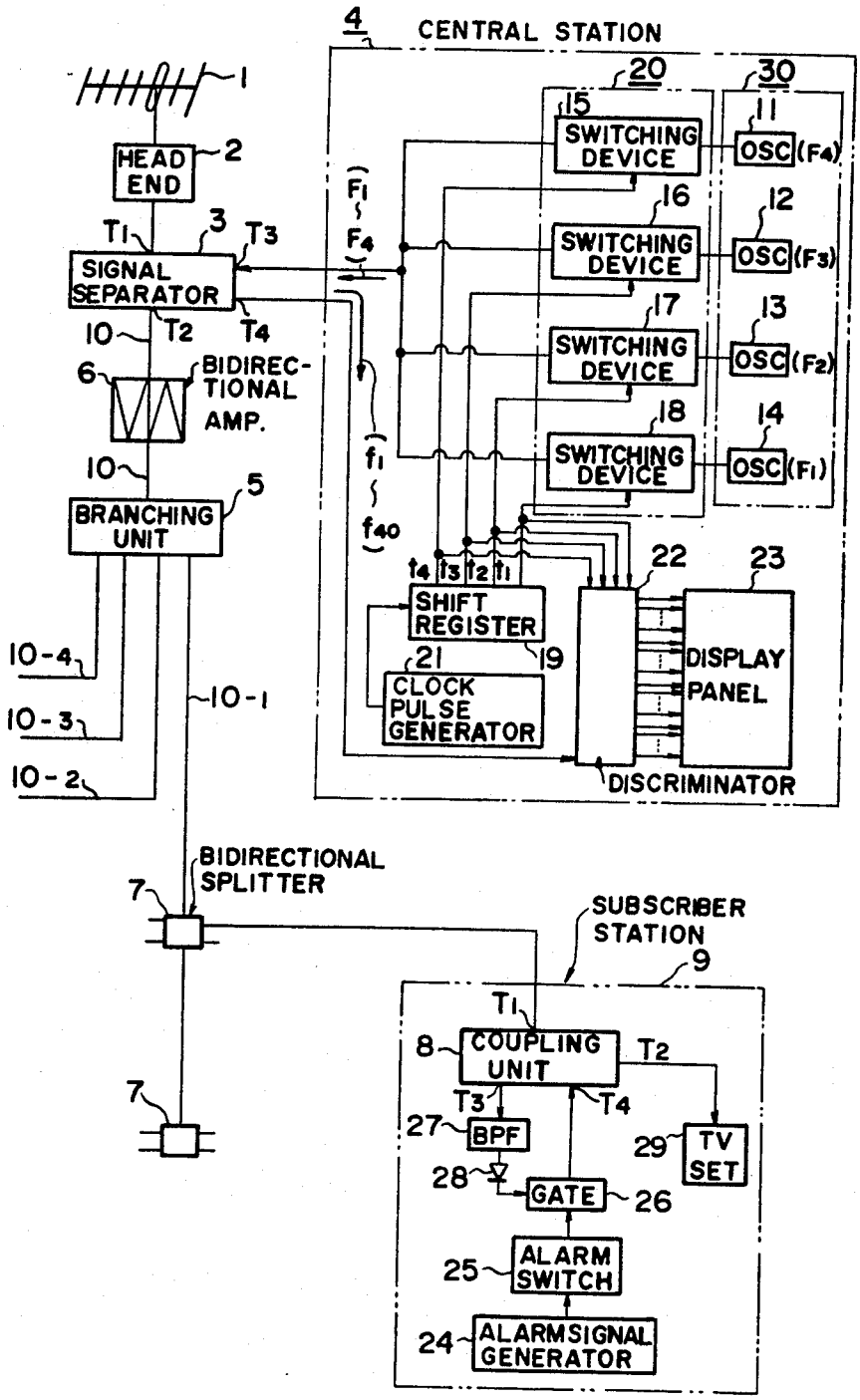
FIG. 1 is a block diagram showing the overall construction of an alarm system according to an embodiment of the invention.

Referring now to FIG. 1, a signal separator 3 is disposed on the front side of a coaxial cable 10 which is connected through a head end 2 to a community antenna 1 of a CATV system, and a central station 4 is connected to the signal separator 3. The coaxial cable 10 is connected by way of a bidirectional amplifier 6 to a branching unit 5 where the coaxial cable 10 is divided into a plurality (four in this embodiment) of coaxial cables 10-1, 10-2, 10-3 and 10-4. As shown in the Figure only for the cable 10-1, each of the branch coaxial cable 10-1 to 10-4 is connected to a plurality of bidirectional splitters 7, and subscriber stations 9 each including a television receiving set 29 are connected to the splitters 7. Although only the single subscriber station 9 is shown in the Figure, a plurality of such subscriber stations are connected to each of the splitters 7, and consequently there is provided a CATV coaxial cable network including a large number of the subscriber stations which are combined in a plurality of the group units with each branch coaxial cable as a unit.

To generate and transmit the necessary interrogating signals for accessing all of the plurality of subscribers of the branch coaxial cables 10-1 to 10-4 group unit by group unit, namely, for sequentially accessing the branch coaxial cables 10-1 to 10-4 one by one, the central station 4 includes a combination of a switching circuit 20 and an oscillator circuit 30 adapted to sequentially generate four signal components respectively having specified high frequencies $F_1$, $F_2$, $F_3$ and $F_4$ which are respectively corresponding to the branch coaxial cables 10-1 to 10-4 and which are different from one another, and a combination of a shift register 19 and a clock pulse generator 21 adapted to sequentially apply the required control signals to the switching circuit 20. Also the central station 4 includes a discriminator 22 for receiving answer signals or alarm signals from the subscriber stations 9 to discriminate the location of each subscriber station which has generated the alarm signal and generate the corresponding output, and a display panel 23 for displaying the location of the subscriber station which has generated the alarm signal in response to the output of the discriminator 22. The oscillator circuit 30 comprises four high frequency oscillators 11, 12, 13 and 14 which respectively generate signal components of the different high frequencies $F_1$, $F_2$, $F_3$ and $F_4$, and the switching circuit 20 comprises four switching devices 15, 16, 17 and 18 which are respectively responsive to control signals $t_1$, $t_2$, $t_3$ and $t_4$ to selectively supply the generated outputs of the oscillators to a terminal $T_3$ of the signal separator 3. In the presennt embodiment, the high frequencies $F_1$ to $F_4$ are assigned so that $F_1$ is assigned to all the subscribers connected to the branch coaxial cable 10-1, $F_2$ is assigned to all the subscribers connected to the cable 10-2, $F_3$ is assigned to all the subscribers connected to the cable 10-3 and $F_4$ is assigned to all the subscribers connected to the cable 10-4. As will be described later, the four high frequency components must be transmitted to the terminals of the CATV system and consequently a frequency band which is close to that of the television signal should preferably be selected as the required frequency band so as to effectively utilize the transmission characteristic of the CATV coaxial cable network. For example, if the previously mentioned high frequencies $F_1$ to $F_4$ consist of the frequencies which fall within the frequency band (108 to 174 $MH_z$) between the upper limit of the FM broadcasting band and the lower limit of the high channel VHF television broadcasting band, the second higher harmonic components of the $F_1$ to $F_4$ will also fall within the frequency band (216 to 470 MHz) between the upper limit of the high channel VHF television broadcasting band and the lower limit of the UHF television broadcasting band, thus preventing the occurrence of beat interference on the television screen due to the second higher harmonic components of the $F_1$ to $F_4$.

Each of the switching devices 15 to 18 may for example be a transistor high frequency class-A amplifier circuit in which the biasing of the amplifying transistor is controlled in such a manner that the class-A amplifier circuit is biased deeper than the class-C amplifier circuit when the control signal ($t_1$ to $t_4$) is not applied, and the amplifier circuit performs the class-A operation when the control signal ($t_1$ to $t_4$) is applied, thus transmitting the input signals $F_1$ to $F_4$ to the signal separator 3. The shift register 19 which generates the previously mentioned control signals $t_1$ to $t_4$ is actuated by the clock pulse generator 21 which generates clock pulses of a predetermined period, whereby the shift register 19 generates sequentially "1" signals or control signals $t_1$, $t_2$, $t_3$ and $t_4$ respectively at its four output terminals, that is, one at a time in response to each clock pulse applied, thus sequentially bringing the switching devices 15 to 18 into operation. The discriminator 22 and the display panel 23 whose constructions are shown in detail in FIG. 2, are designed so that at least one alarm signal or up-signal having the specified frequency and received from any subscriber station 9 through the signal separator 3, is discriminated and the AND operation is performed on the result of the discrimination and any of the control signals $t_1$ to $t_4$ to indicate which subscriber of which group unit has generated the alarm signal.

Figure 2:
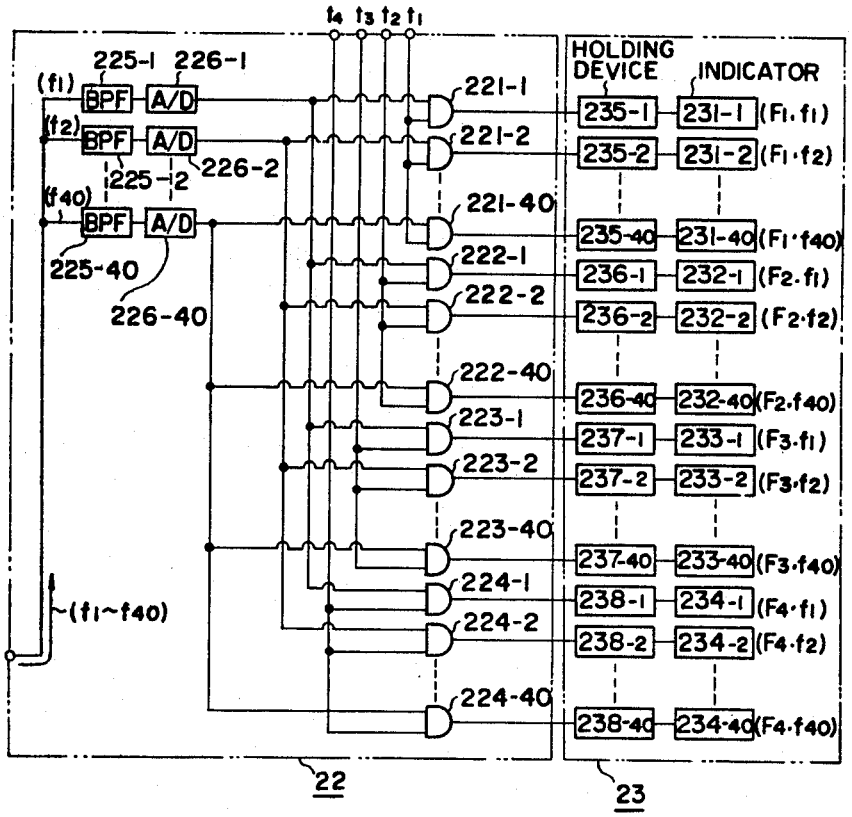
FIG. 2 is a detailed circuit diagram showing, part in block form, the discriminator and the display panel shown in FIG. 1.

In FIG. 2, the discriminator 22 comprises a plurality of band-pass filters 225-1 to 225-40 for receiving the alarm signals through the signal separator 3 to separate the signals into frequency components $f_1$ through $f_{40}$, A/D converters 226-1 to 226-40 for respectively subjecting the outputs of the band-pass filters to analog-to-digital conversion, and a large number of AND gates 221-1 to 221-40, 222-1 to 222-40, 223-1 to 223-40 and 224-1 to 224-40 which are connected to the A/D converters 226-1 to 226-40 so that the output terminal of each A/D converter is connected to four of the AND gates to perform the AND operation on the output of the A/D converter and each of the control signals $t_1$, $t_2$, $t_3$ and $t_4$. In other words, it is assumed that each of the four group units or the branch coaxial cables 10-1 to 10-4 includes the fourty subscriber stations 9 connected thereto and that the specified frequencies $f_1$ to $f_{40}$ which are common to all the group units are assigned to the forty subscriber stations of every branch coaxial cable. The AND gates 221-1 to 221-40 are each adapted to receive at its one input terminal the control signal $t_1$ and at its other input terminal the output of the corresponding one of the A/D converters 226-1 to 226-40. The AND gates 222-1 to 222-40, 223-1 to 223-40 and 224-1 to 224-40 respectively receive at their one input terminals the control signals $t_2$, $t_3$ and $t_4$ and at their other input terminals the outputs of the corresponding ones of the A/D converters 226-1 to 226-40 in the similar manner as the AND gates 221-1 to 221-40. As a result, when the signal $F_1$ is transmitted to the coaxial cable 10, the AND gates 221-1 to 221-40 are accessed by the control signal $t_1$ so that when an alarm signal is applied to any band-pass filter, one of the AND gates 221-1 to 221-40 receives an input through the band-pass filter and the A/D converter corresponding to the specific frequency of the applied alarm signal, and this AND gate generates an output. In other words, the AND gates 221-1 to 221-40 serve to discriminate all the subscriber stations in the group unit of the branch coaxial cable 10-1, and similarly the AND gates 221-1 to 222-40 discriminate the subscriber stations connected to the branch coaxial cable 10-2, the AND gates 223-1 to 223-40 the subscriber stations connected to the branch coaxial cable 10-3 and the AND gates 224-1 to 224-40 the subscriber stations connected to the cable 10-4.

The display panel 23 comprises holding devices 235-1 to 235-40, 236-1 to 236-40, 237-1 to 237-40 and 238-1 to 238-40 consisting for example of thyristors which are triggered by the outputs of the associated AND gates and indicators 231-1 to 231-40, 232-1 to 232-40, 233-1 to 233-40 and 234-1 to 234-40 which are actuated by the outputs of the associated holding devices, and each of the indicators is adapted to separately indicate which subscriber station of which group unit has generated the alarm signal in response to the indication of such frequency combination as $F_1 \cdot f_1$ which is affixed at right side of indicators in FIG. 2.

Each of the subscriber stations 9 comprises a television receiving set 29, an alarm signal generator 24 for generating a low frequency signal having the specified one of the low frequencies $f_1$ to $f_{40}$ which is assigned to the subscriber station, an alarm switch 25 connected to the output of the generator 24 and consisting for example of a manual transmission switch or automatic switch controlled by the action of an automatic sensor for sensing a fire, burglary or the like, an analogue gate device 26 which when actuated selectively passes the alarm signal applied to it through the alarm switch 25, a band-pass filter 27 which passes only one of the high frequency signals $F_1$ to $F_4$ corresponding to the group unit to which the subscriber station belongs, and a detector 28 adapted to detect the output of the band-pass filter 27 and actuate the analogue gate device 26 by the resulting detected output. The subscriber station 9 also comprises a coupling unit 8, whereby the television signal fed through the antenna is applied to the TV set 29, the signals $F_1$ to $F_4$ from the central station 4 are applied to the band-pass filter 27 and the alarm signal is transmitted to the coaxial cable through the splitter 7.

In this connection, as for example, each of the forty subscriber stations connected to the branch coaxial cable 10-1 includes the band-pass filter 27 which passes only the signal $F_1$, and the frequencies $f_1$ to $f_{40}$ are respectively assigned to the output frequencies of the alarm signal generators 24 of the subscriber stations. Similarly, the band-pass filters of the subscriber stations connected to the branch coaxial cable 10-2 are adapted to pass only the signal $F_2$, the band-pass filters of the subscriber stations connected to the cable 10-3 pass only the signal $F_3$, and the band-pass filters of the subscriber stations connected to the cable 10-4 pass only the signal $F_4$.

By for example using the low frequencies within the band of 1 to 4 KHz, separating them at a spacing of 30 to 100 Hz and assigning them as the previously mentioned low frequencies $f_1$ to $f_{40}$, the band-pass filters 225-1 to 225-40 may each be comprised of an inexpensive mechanical filter, such as, a tone filter employing a tuning fork.

Figure 3:
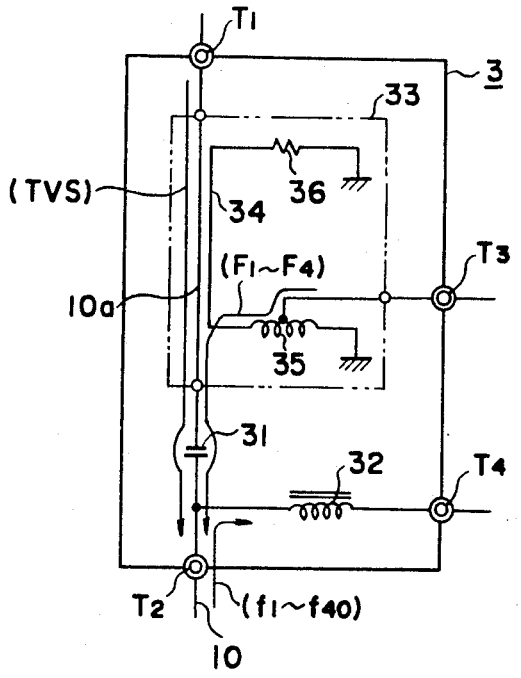
FIG. 3 is a circuit diagram showing in detail the construction of the signal separator shown in FIG. 1.

FIG. 3 shows an exemplary circuit construction of the signal separator 3 connected to the coaxial cable 10 to connect it to the central station 4. More specifically, the signal separator 3 is so designed that a television signal TVS applied to a first terminal $T_1$ from the head end 2 is transmitted to the coaxial cable 10 through a coupling line 10*a* and a high-pass filter 31 and through a second terminal $T_2$, the signals $F_1$ to $F_4$ applied to a third terminal $T_3$ from the central station 4 are transmitted to the coaxial cable 10 through a directional coupler 33 comprising an inductive coupling conductor 34 wired parallel to the coupling line 10*a*, a tapped coil 35 and a resistor 36 and the high-pass filter 31 and through the second terminal $T_2$, and the alarm signal or signals (having one or more of the frequencies $f_1$ to $f_{40}$) applied to the second terminal $T_2$ are transmitted as the up signal or signals to the central station 4 through a low-pass filter 32 and a fourth terminal $T_4$.

The bidirectional amplifier 6 shown in FIG. 1 may be comprised of an AC power-passing type up-signal amplifying line amplifier which is used with the ordinary CATV system so as to transmit the up-signals through an AC power passage or alternatively a combination of an down-signal high frequency amplifier and a up-signal low frequency amplifier may be used. Also the branching unit 5 may be comprised of the AC power passing type which is used with the ordinary CATV coaxial cable network and employing a hybrid coil so as to divide and pass the television signal and the interrogating signals $F_1$ to $F_4$ to the branch coaxial cables 10-1 to 10-4 with reduced power loss. Also the bidirectional splitters 7 may each be comprised for example of an AC power-passing type hybrid spitter.

Figure 4:
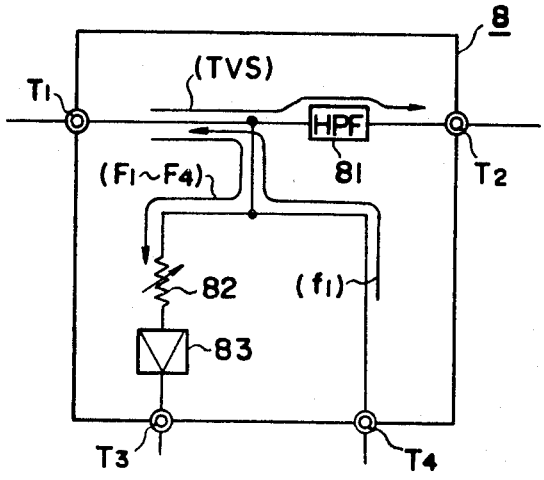
FIG. 4 is a circuit diagram showing in detail the construction of the coupling unit shown in FIG. 1.

On the other hand, the coupling unit 8 in each subscriber station 9 is constructed as shown in FIG. 4. In the Figure, the coupling unit 8 is designed so that the television signal TVS and the interrogating signals $F_1$ to $F_4$ which are applied to a first terminal $T_1$ connected to the splitter 7 are divided, that is, the television signal TVS is transmitted to the TV set 29 through a high-pass filter 81 and a second terminal $T_2$ and the signals $F_1$ to $F_4$ are transmitted to the band-pass filter 27 through an attenuator 82 and an amplifier 83 and through a third terminal $T_3$, and the alarm signal (the signal of the frequency $f_1$ is shown in the Figure) applied to a fourth terminal $T_4$ from the alarm signal generator 24 is transmitted as an up-signal to the splitter 7 through the first terminal $T_1$.

Next, the operation of this embodiment will be described hereunder with reference to FIGS. 1 to 4.

Firstly, the television signal TVS is received by the community antenna 1 from which the signal is applied to the first terminal $T_1$ of the signal separator 3 through the head end 2. In the signal separator 3, the television signal TVS applied to the first terminal $T_1$ is delivered as such to the second terminal $T_2$ through the coupling line 10a and the high-pass filter 31. The television signal TVS is then delivered through the second terminal $T_2$ to the coaxial cable 10, and after having been amplified by the bidirectional amplifier 6 to a desired gain as occasions demand, the television signal TVS entering the branching unit 5 divides and passes to the branch coaxial cables 10-1, 10-2, 10-3 and 10-4. The television signal TVS transmitted to each of the branch coaxial cables is further divided and passed to the subscriber stations 9 through the bidirectional splitters 7.

When applied to each subscriber station 9, the television signal TVS is received by the television receiving set 29 connected to the second terminal $T_2$ through the first terminal $T_1$ of the coupling unit 8 and the high-pass filter 81. With the illustrated embodiment, assuming that the VHF band of 108 to 107 MHz is assigned to the high frequency signal components $F_1$ to $F_4$ of interrogating signals as mentioned previously and that the voice frequency band, e.g., the low frequency band of 1 to 4 KHz is assigned to the output signal frequencies $f_1$ to $f_{40}$ of the alarm signal generators 24 in the subscriber stations connected to each branch coaxial cable, it is necessary that the high-pass filters 31 and 81 of the signal separator 3 and the coupling units 8 each has a pass band extending from 54 MHz up to 870 MHz and the low-pass filter 32 of the signal separator 3 passes only the low frequency signals lower than 4 KHz.

With the above-mentioned selection of the filters, the television signal TVS is received by the television receiving set 24 of each subscriber station through the above-mentioned route.

With the system described, the transmission and reception of alarm signals are effected in the following manner. In the central station 4, the oscillators 11 to 14 of the oscillator circuit 30 respectively generate output signals of the frequencies $F_1$ to $F_4$, respectively. On the other hand, the clock pulse generator 21 generates clock pulses of a predetermined period, and the shift register 19 sequentially generates "1" signals at its output terminals, one at a time in response to every clock pulse applied, so that starting with the control signal $t_1$, the control signals $t_1$ to $t_4$ are sequentially changed to a "1" signal, that is, the control signal $t_1$ changes to a "0" signal when the next control signal $t_2$ changes to a "1" signal and this process is repeated to change the signals periodically to shift the "1" signal.

As the control signals $t_1$ to $t_4$ are sequentially changed to "1" signal, the switching devices 15 to 18 are sequentially actuated, and consequently the output of the oscillator in the oscillator circuit 30 which is connected to the actuated switching device is applied to the third terminal $T_3$ of the signal separator 3. At the same time, the control signals $t_1$ to $t_4$ are applied as gate input signals to the AND gates 221-1 to 224-40 of the discriminator 22. By virtue of this sequential actuation of the switching devices 15 to 18, the high frequency signals $F_1$ to $F_4$ are sequentially applied from the central station 4 to the third terminal $T_3$ of the signal separator 3, and then the signals are transmitted as interrogating signals or polling down-signals to the coaxial cable 10 through the directional coupler 33 and the high-pass filter 31. The high frequency signals $F_1$ to $F_4$ are amplified by the bidirectional amplifier 6, and then the branching unit 5 sequentially divides and transmits the signals to the branch coaxial cables 10-1 to 10-4. As a result, the signals $F_1$ to $F_4$ are sequentially transmitted to all the subscriber stations simultaneously as in the case of the television signal TVS. In each subscriber station 9, the coupling unit 8 applies the television signal TVS to the television set 29 through the high-pass filter 81 and it also applies the signals $F_1$ to $F_4$ to the band-pass filter 27 through the attenuator 82 and the amplifier 83. Of these signal components $F_1$, $F_2$, $F_3$ and $F_4$, only that signal component which corresponds to the branch coaxial cable or the group unit to which the subscriber station belongs, e.g., the signal component $F_1$ is passed through the bandpass filter 27 and it is then detected by the detector 28. In other words, since the signals $F_1$, $F_2$, $F_3$ and $F_4$ are sequentially shifted periodically to "1" signal for a predetermined duration time in response to the operation of the shift register 19, the detector 28 generates a detection output only during the duration time of the corresponding one of the four signals, and this process is repeated periodically. This detection output is applied to the analogue gate device 26 and consequently the analogue gate device 26 is acuated periodically. Thus when the analogue gate device 26 is in operation, the output signal of the alarm signal generator 24 or the alarm signal can be transmitted to the fourth terminal $T_4$ of the coupling unit 8 through the alarm switch 25. As a result, when the alarm switch 25 of the subscriber station 9 is actuated in response to the occurrence of an abnormal condition, the alarm signal is delivered to the fourth terminal $T_4$ of the coupling unit 8 in synchronism with the detection output, and then the signal is transmitted to the associated branch coaxial cable through the first terminal $T_1$ of the coupling unit 8 and the splitter 7. The alarm signal is further transmitted through the branching unit 5, the coaxial cable 10 and the bidirectional amplifier 6 to the second terminal $T_2$ of the signal separator 3, and then the signal is applied through the low-pass filter 32 and the fourth terminal $T_4$ of the signal separator 3 to the discriminator 22 of the central station 4. In the discriminator 22, the alarm signal is applied to the band-pass filters 225-1 to 225-40, so that the alarm signal passes through one of these filters or that filter which passes a frequency corresponding to the specified frequency of the alarm signal, and then the signal is applied only to one of the A/D convertors 226-1 to 226-40 which is connected to that particular filter. Consequently, this particular A/D converter generates a "1" signal which in turn is passed, along with one of the control signals $t_1$, $t_2$, $t_3$ and $t_4$, through one of the AND gates to actuate the corresponding indicator through one of the holding devices. In this way, the group unit to which the subscriber station generating the alarm signal belongs, is discriminated in accordance with one of the signals $F_1$, $F_2$, $F_3$ and $F_4$ or the control signals $t_1$, $t_2$, $t_3$ and $t_4$, and the location of the subscriber station in the group unit is discriminated in accordance with the specified low frequency of the alarm signal (one of the frequencies $F_1$ to $F_{40}$), thus causing the actuated indicator to give an indication corresponding to the subscriber station in accordance with the combination of the discrimination results. For instance, with the interrogating signal or high frequency signal $F_1$ being transmitted from the central station 4 to the subscriber stations, when the alarm switch is closed in the subscriber station which is connected to the branch coaxial cable 10-1 and to which the low frequency $f_1$ is assigned, the signal $f_1$ is passed through the band-pass filter 225-1 during the time that the control signal $t_1$ is applied from the shift register 19 to one input terminals of the AND gates 221-1 to 221-40 in the discriminator 22, so that the A/D convertor 226-1 applies a "1" signal to the other imput terminals of the AND gates 221-1, 222-1, 223-1 and 224-1 and only the AND gate 221-1 generates an output. Consequently, the holding device 235-1 is triggered and only the indicator 231-3 is brought into operation, thus indicating the occurrence of the abnormal condition at the location of the subscriber station specified by the low frequency $f_1$ and belonging to the group unit specified by the high frequency $F_1$.

On the other hand, when an alarm signal is generated from the subscriber station which is connected to the branch coaxial cable 10-1 and to which the low frequency $f_{40}$ is assigned, similarly the indicator 231-40 is brought into operation. When an alarm signal is generated from the subscriber station which is connected to the branch coaxial cable 10-4 and to which the low frequency $f_2$ is assigned, the indicator 234-2 is brought into operation. Even if these signals are generated simultaneously, the corresponding indicators are sequentially started to operate in accordance with the shift timing of the shift register 19.

It will thus be seen from the foregoing that in accordance with the alarm system of this invention, a large number of terminals ($4\times40$ terminals in the illustrated embodiment) can be discriminated with a relatively small number ($4+40$) of frequencies alone, and the discrimination of the terminals is simplified without using a large number of modulators, demodulators and filter as in the case of the known system in which the group discrimination frequencies $F_1$ to $F_4$ are modulated by the terminal discrimination frequencies $f_1$ to $f_{40}$. While this system is not adapted to give the types of alarm, this deficiency can be satisfactorily overcome by adapting the system for use over a short distance so that the person in charge can immediately visit the location where an abnormal condition has occurred, and there is another advantage that each subscriber is required to simply depress the switch in case of need, thus simplifying the operation and eliminating the occurrence of erroneous operations.

Of course, the number of terminals as well as the number of terminals in each group unit can be changed as desired. Further, while the group designating polling signals are delivered as down-signals and the alarm signals from the terminals are delivered as up-signals, by assigning for example high frequencies which are close to the television frequency band to the former and low frequencies in the voice signal band to the latter, the required signal separation, amplification and the like may be separately effected simply by means of filters.

We claim:

1. In an alarm system utilizing a bidirectional CATV system to remotely monitor a large number of subscribers of said CATV system from a central station connected to a front side of said CATV system, the improvement comprising:

(a) a large number of subscriber stations located one at each subscriber's location, said subscriber stations having locations in group units;

(b) a large number of alarm signal generators disposed one in each said subscriber station, said alarm signal generators each being adapted to generate an alarm signal having one of first frequencies which are common to respective of said group units, said first frequencies being different for respective subscriber stations in respective group units;

(c) interrogating signal generating means disposed in said central station to sequentially periodically generate repeatedly as interrogating signals a plurality of signal components of second frequencies which are different for respective of said group units, said second frequencies being different from said first frequencies of said alarm signals;

(d) signal separating means disposed to transmit as down-signals said interrogating signals from said central station and a television signal from a head end of said CATV system to a transmission cable of said CATV system and to transmit said alarm signals to said central station through said transmission cable;

(e) branching means connected to said transmission cable to divide and transmit said television signal and said interrogating signals to said group units;

(f) alarm switch means disposed in each said subscriber station so as to be actuated in response to the occurrence of an abnormal condition at the location of each said subscriber station, said alarm switch means being connected to said alarm signal generator in each said subscriber station;

(g) detector means disposed in each said subscriber station, whereby when said interrogating signals are applied to each said subscriber station, said detector means detects only a specific signal component having one of said second frequencies corresponding to the group unit to which each said subscriber station belongs;

(h) analogue gate means disposed and connected to said alarm switch means in each said subscriber station so as to be actuated by a detection output of said detector means in synchronism with a period of said specific signal component, whereby when said analogue gate means is actuated, said alarm signal from said alarm signal generator is passed through said analogue gate means through said alarm switch means;

(i) coupling means disposed in each said subscriber station to separately pass therethrough said television signal and said interrogating signals applied from said transmission cable and to transmit as an up-signal said alarm signal from said analogue gate means to said transmission cable;

(j) discriminator means disposed in said central station, whereby when at least one said alarm signal is received from said transmission cable through said signal separating means, said discriminator means receives at its inputs an information indicative of one of said first frequencies corresponding to the frequency of said alarm signal and another information indicative of one of said second frequencies corresponding to the signal component of the interrogating signal being transmitted at the time of the reception of said alarm signal to thereby discriminate the location of the subscriber station generating said alarm signal in accordance with the combination of said informations; and (k) indicator means disposed in said central station so as to be controlled by said discriminator means to give an indication corresponding to the location of the subscriber station generating said alarm signal.

2. An alarm system as set forth in claim 1, wherein said interrogating signal generating means comprises a plurality of VHF oscillators for generating the signal components of said second frequencies, whereby said signal components transmitted to each said subscriber station from said central station have a frequency band falling within a transmission band of said transmission cable of said CATV system.

3. An alarm system as set forth in claim 1, wherein said interrogating signal generating means comprises a shift register adapted to control a duration time and repetition cycle of each said signal component, and a clock pulse generator for driving said shift register.

4. An alarm system as set forth in claim 1, wherein said discriminator means comprises band-pass filter means for receiving said alarm signals from said signal separating means to detect and separate the same into said first frequencies, and a plurality of AND gate means each being adapted to receive at its one input terminal one of a plurality of first binary code signals each having a signal content indicative of the presence or absence of one of said plurality of signal components and to receive at its other input terminal one of a plurality of second binary code signals each having a signal content indicative of the presence or absence of one of a plurality of detection outputs of said band-pass filter means, and wherein said indicator means comprises a plurality of indicators each being adapted to be controlled by an output of corresponding one of said AND gate means.

* * * * *